United States Patent [19]

Flynn

[11] 3,948,285

[45] Apr. 6, 1976

[54] PRESSURE AND FLOW REGULATION DEVICE

[75] Inventor: Charles J. Flynn, Glendora, Calif.

[73] Assignee: Rain Bird Sprinkler Mfg. Corporation, Glendora, Calif.

[22] Filed: Jan. 29, 1975

[21] Appl. No.: 545,241

[52] U.S. Cl. ..... 137/494; 137/505.13; 138/30; 239/230; 239/570

[51] Int. Cl.[2] ..... B05B 1/30

[58] Field of Search ..... 239/76, 569, 570, 262, 239/542, 204, 230; 137/494, 505.13; 169/37; 138/30

[56] References Cited

UNITED STATES PATENTS

| | | | |
|---|---|---|---|
| 2,176,243 | 10/1939 | Braungart | 239/262 X |
| 2,336,725 | 12/1943 | Englehart | 239/262 |
| 3,730,215 | 5/1973 | Conery et al. | 137/494 |
| 3,863,844 | 2/1975 | McMillan | 239/570 X |
| 3,871,457 | 3/1975 | Livingston | 169/37 X |
| 3,876,155 | 8/1975 | Ruben | 239/542 |

*Primary Examiner*—John J. Love
*Assistant Examiner*—Michael Mar
*Attorney, Agent, or Firm*—Fulwider, Patton, Rieber, Lee & Utecht

[57] ABSTRACT

For use in a sprinkler system a pressure and flow regulation device comprising a snap acting valve which includes a movable valve closure having a spring biasing the valve closure toward a closed position and a diaphragm having a surface disposed to be acted upon by inlet water pressure to urge the valve closure to an open position against the bias of the spring, only when a predetermined inlet pressure is reached, and a pressure regulator constructed integrally with the snap acting valve for automatically regulating the pressure of water supplied to a sprinkler to a selected level.

7 Claims, 5 Drawing Figures

PRESSURE AND FLOW REGULATION DEVICE

BACKGROUND OF THE INVENTION

This invention relates generally to sprinkler systems, such as those used for watering crops or gardens, and, more particularly, to devices for the regulation of water pressure and flow in such sprinkler systems.

As is well known in the art, it is highly desirable to incorporate a plurality of pressure regulation devices into water sprinkler systems, to enable each sprinkler in the system to operate at an optimum or desired pressure without regard to pressure losses in distribution pipes connecting the sprinklers to a common water supply. It has also been recognized that another highly desirable feature for sprinkler systems is some kind of flow regulation device, usually taking the form of a pressure-actuated check valve, to prevent water flow from the sprinkler until a minimum supply pressure is reached. The check valve thereby minimizes or eliminates erosion damage inflicted by low pressure water flow onto the soil surrounding each sprinkler.

In sprinkler systems available heretofore, the functions of the pressure regulator and the check valve have been performed by separate devices. Moreover, usually only one check valve is provided, in the common water supply line, and this does not effectively prevent low-pressure flow from all of the sprinklers in a relatively large system. Accordingly, there has existed a definite need for a convenient, effective and economical device for use as a pressure regulator and check valve with each sprinkler in the system. The present invention satisfies this need.

SUMMARY OF THE INVENTION

The present invention resides in the novel combination of pressure-actuated check valve means and pressure regulation means into a unitary structure for connection with a single sprinkler in the system, there being an additional similar combination for each other regulated sprinkler in the system. Consequently, each sprinkler in the system has an independently pressure-regulated supply, and has its own pressure-actuated check valve to prevent undesirable low-pressure flow.

More specifically, a presently preferred embodiment of the invention includes a check valve with a resiliently mounted diaphragm which snaps the valve open positively when a predetermined minimum supply pressure is reached, and, constructed integrally with the check valve so as to form a single interrelated device is a pressure regulating disk cooperating with the check valve diaphragm to provide a constant pressure source of water to the associated sprinkler.

The diaphragm of the check valve is exposed to the water supply pressure on one side and to atmospheric pressure in a vented chamber on its other side. In one alternative form of the invention, the chamber has connected to it a pressure conduit, by means of which the check valve can be overriden by applying a low or vacuum pressure to the conduit or by applying a positive pressure to the chamber to increase the line pressure necessary to open the check valve.

It will be appreciated from the foregoing that the present invention represents a significant advance over previously available pressure and flow regulation devices for sprinkler systems, principally because it provides the dual functions of a pressure regulator and a check valve in a single device, for connection at each controlled sprinkler in the system. Other aspects and advantages of the invention will become apparent from the following more detailed description taken in conjunction with the accompanying drawings.

DETAILED DESCRIPTION

Figure 1:
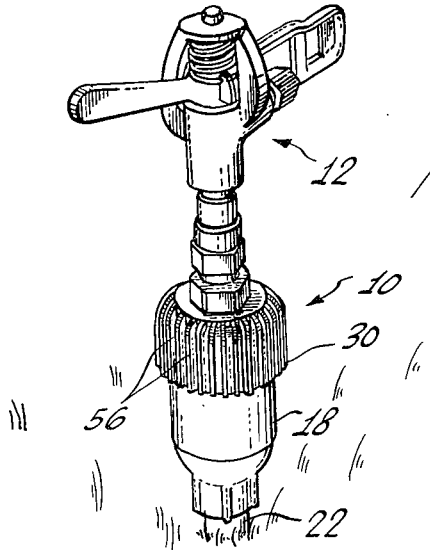
FIG. 1 is a perspective exterior view of a device embodying the invention, assembled together with a conventional sprinkler of the impact arm type.

As shown in the drawings for purposes of illustration, the present invention is embodied in a unitary device, indicated generally by reference numeral 10, for the regulation of pressure and flow of water to a sprinkler 12, which is shown in FIG. 1, by way of example, as a conventional impact-arm-type sprinkler. In sprinkler systems, it is highly desirable to regulate the pressure and flow to each sprinkler independently, so that each may operate at an optimum or desired supply pressure, and so that soil erosion caused by low-pressure flow are minimized or eliminated.

In accordance with the present invention, a pressure regulator disk 14 is combined with a pressure-actuated check valve 16 in the unitary device 10, for connection with a sprinkler. Thus, the supply pressure and flow to each sprinkler may be conveniently and independently regulated.

Figure 2:
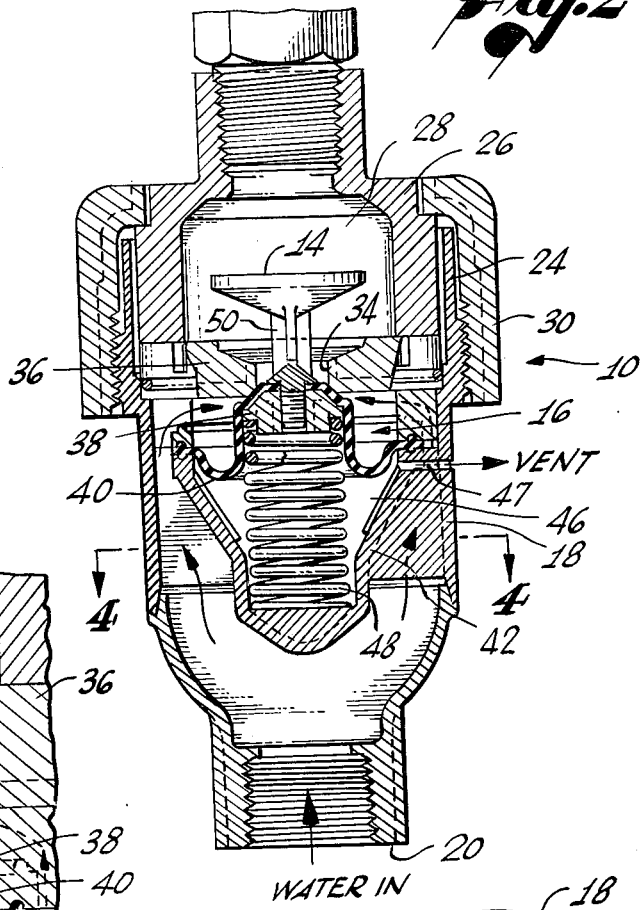
FIG. 2 is an enlarged, partly sectional view of the device, showing the check valve in a closed position.
Figure 3:
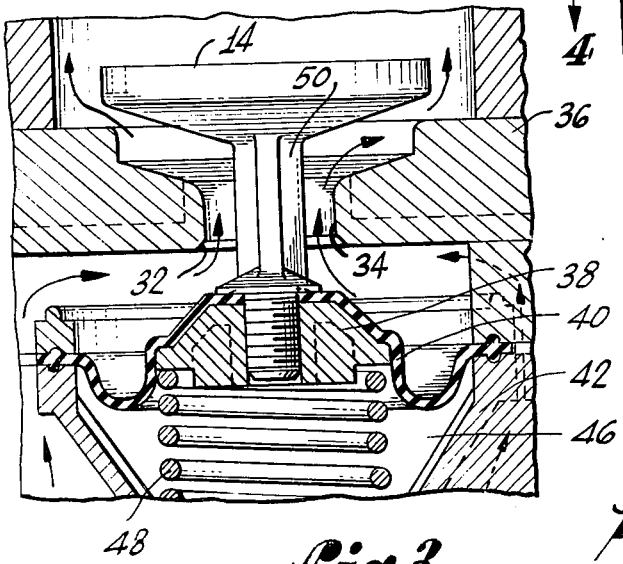
FIG. 3 is a further enlarged, fragmentary view, also partly in section, showing the check valve in an open position.
Figure 4:
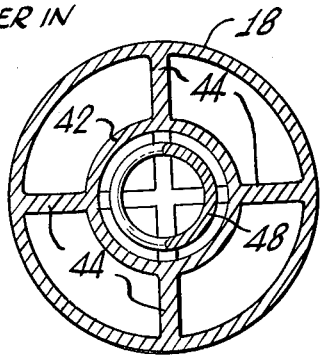
FIG. 4 is a sectional view taken substantially along the line 4—4 in FIG. 2.

As best shown in FIGS. 2–4, the device 10 has a generally cylindrical hollow housing 18 enclosing the check valve 16 and having an inlet end 20 which is threaded internally to allow coupling with a water supply line 22 (FIG. 1), and an outlet end 24 which is sealably engageable with a generally cylindrical pressure regulator body 26 defining a chamber 28 in which the pressure regulator disk 14 is located. The pressure regulator body 26 is retained in an assembled relationship with the housing 18 by means of a retaining cap 30 which threadably engages the outlet end 24 of the housing and bears down on the pressure regulator body 26.

The check valve 16 includes a valve seat 32, defined by a circular opening 34 in a baffle plate 36 located in the housing 18, and a generally conically shaped valve closure 38 to which is secured a resilient diaphragm 40, part of which forms a sealing surface for the closure 38. A cup-shaped vessel 42 is rigidly supported inside the housing 18 by radial webbing plates 44 (FIG. 4), and the diaphragm 40 is, in turn, secured to the vessel by its periphery to form a closed chamber 46. Extending through the side of the vessel 42 is a passage 47 communicating with the atmosphere to provide a vent for the chamber 46. It can be seen, then, that the diaphragm 40 is exposed to the water supply pressure on one side and to atmospheric pressure in the chamber 46 on the other. The check valve 16 also includes a compressed spring 48 located in the chamber 46 and urging the valve closure 38 into a closed position.

When the water inlet pressure reaches a sufficiently high, predetermined pressure to overcome the closing force of the spring 48, the valve closure 38 will be slightly "cracked" from its seat 32. This exposes a larger area of the closure 38 to the inlet pressure, and the valve will snap open in a positive manner against the force of the spring 48.

The pressure regulating disk 14 is mounted on a stem 50 which is rigidly attached to the valve closure 38. The disk 14 moves back and forth in an axial direction, to regulate the pressure of the water supplied to the sprinkler 12 by controlling the amount of flow into the regulator chamber 28. These movements of the disk 14 are relatively small compared with the stroke of the valve closure 38, and have substantially no effect on the check valve 16 once it is opened.

Figure 5:
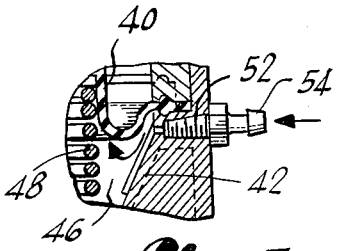
FIG. 5 is a fragmentary view of an alternative form of the device having an external pressure conduit connected with the check valve.

As FIG. 5 illustrates, the chamber 46 may be connected through a pressure conduit 52 and an external fitting 54 to an external pressure source (not shown). This arrangement allows the check valve 16 to be overriden hydraulically by the application of a high pressure to the chamber 46 thereby assisting the spring 48 in biasing the check valve to the closed position. Alternately, a negation or low pressure can be applied to the conduit 52 to permit a lower line pressure to open the check valve 16.

All of the component parts of the device 10, except the diaphragm 40 and spring 48, can be conveniently and economically fabricated from moldable plastic materials. The retaining cap 30 may be conveniently removed to dismantle and clean the device, and may, as shown in FIG. 1, have external ribs 56 to facilitate removal by hand.

In operation of the device 10, no flow to the sprinkler 12 will occur until the inlet pressure from the supply line 22 acting on the diaphragm 40 reaches a value sufficient to overcome the counter force of the spring 48. When that value is reached and exceeded, the diaphragm snaps open to permit water to flow around the regulator disk 14 to the sprinkler 12 for discharge through the sprinkler nozzle. On reaching the sprinkler, back pressure is created due to the constriction of the sprinkler nozzle, and that pressure acts on the upper face of the regulator disk to cause the regulator to commence its regulation operation.

Thus, in a very short time after opening of the check valve 16, the device 10 begins operation to supply and maintain water to the sprinkler 12 at a pressure substantially equal to the line pressure of the supply line 22. So long as that line pressure from the supply line 22 acting over the full area of the diaphragm 40 does not fall below the oppositely acting force created by the spring 48, the check valve 16 will remain fully open and only very small pressure losses due to friction and the like will be present between the inlet 20 to the device 10, and the sprinkler 12.

Preferably, the effective area of the diaphragm 40 over which water pressure acts when the check valve 16 is fully open is equal to the effective surface area of the underside of the regulator disk 14 so that water pressure acting over the area of the diaphragm in a direction to open the check valve is balanced by the water pressure acting over the underside of the pressure regulator disk tending to close the check valve. In this manner, regulation of the water pressure to the sprinkler 12 is governed by the force of the spring 48 and the water pressure acting over the upper surface of the pressure regulator disk 14 which acts in a direction to oppose the spring.

When operating, therefore, if a force unbalance exists between the spring 48 tending to raise the regulator disk 14, and the water pressure acting on the upper surface of the disk in a direction to lower the disk, the regulator disk will move axially to increase or decrease the amount of water admitted into the regulator chamber 28, thereby to increase or decrease the pressure acting on the upper surface of the regulator disk. Thus, the pressure admitted to the sprinkler 12 is controlled by the force of the spring 48, and if a particular pressure is desired, a spring having the desired force parameters can be selected for that pressure and can be installed to insure that the specific pressure is maintained.

As illustrated in the alternative embodiment of FIG. 5, the operation of the check valve 16 can be independently controlled and overridden by providing the fluid conduit 52 to the spring chamber 46. Upon application of a positive pressure to the chamber 46, there is created a force on the underside of the diaphragm 40 tending to close the check valve 16 thereby increasing the value of the inlet pressure from the supply line 22 necessary to initially open the device 10. Once opened, the device 10 of FIG. 5 operates in a manner similar to that of the device of FIGS. 1 through 4 except that regulation is achieved at a level which includes both the spring force and the applied pressure within the chamber 46. Alternatively, the inlet pressure necessary to open the check valve 16 and the regulation pressure can be lowered by applying a vacuum or negative pressure to the chamber 46 through the conduit 52.

It will be appreciated from the foregoing description that the present invention provides a hitherto unavailable combination of check valve and pressure-regulation functions in a single economical unit. It will also be appreciated that, although a particular embodiment of the invention has been described in detail for purposes of illustration, various modifications may be made without departing from the spirit and scope of the invention. Accordingly, the invention is not to be limited, except as by the appended claims.

I claim:

1. For use in a sprinkler system, a pressure and flow regulation device comprising:

a pressure actuated, snap acting valve for positively initiating flow to a sprinkler only after a predetermined minimum supply pressure is reached, said snap acting valve including:

valve closure means movable between open and closed position, means biasing said valve closure toward said closed position, and diaphragm means coupled with said valve closure and having a surface disposed to be acted upon by water pressure to urge said valve closure to said open position, said diaphragm serving to open said valve closure slightly when the supply pressure reaches said predetermined pressure and to thereby expose a larger area of said valve closure to the supply pressure and force it rapidly open against the bias of said biasing means; and pressure regulation means constructed integrally with said snap acting valve for automatically regulating the pressure applied to the sprinkler to a selected value, whereby said snap acting valve eliminates undesirable low pressure flow to the sprinkler, and said pressure regulation means ensures that the sprinkler operates at a desired optimum pressure.

2. A device as set forth in claim 1, including means defining a chamber within which said biasing means is contained and in which said diaphragm defines a wall of said chamber.

3. A device as set forth in claim 2, wherein said pressure regulation means includes a pressure-regulating disk rigidly connected to said valve closure means.

4. A device as set forth in claim 3, and further including pressure conduit means connected with said chamber means, for overriding hydraulically the operation of said snap acting valve means by application of fluid pressure in to said chamber means.

5. For use in a sprinkler system, a combined pressure regulation and flow check valve device, comprising:

pressure-actuated check valve means for positively initiating flow to a sprinkler as a predetermined minimum supply pressure is reached, including valve closure means movable between open and closed positions, resilient means for urging said valve closure means toward said closed position, chamber means, and diaphragm means defining a wall of said chamber means, for positively moving said valve closure means to said open position, whereby the predetermined minimum supply pressure is sufficient to open said valve closure means slightly, thereby exposing a larger area of said valve means to the supply pressure and forcing it rapidly open;

pressure regulation means constructed integrally with said check valve means, for automatically regulating the pressure applied to the sprinkler to a predetermined value, and including a pressure-regulating disk rigidly attached to said valve closure means, and pressure-regulator chamber means surrounding said disk; and removable retaining means for holding said pressure-regulator chamber means in an assembled position with respect to said disk and said check valve means.

6. A device as set forth in claim 5 in which said resilient means comprises a spring, and said pressure regulating disk comprises upper and lower surfaces exposed to water pressure, said water pressure acting in said lower surface to open said regulator disk, and said water pressure acting on said upper surface to close said disk.

7. A device as set forth in claim 6 wherein the effective area of said lower surface of said regulator disk over which said pressure acts is substantially equal to the effective area of said diaphragm means over which said supply pressure acts, whereby the pressure force on said lower surface of said disk substantially cancels the pressure force on said diaphragm means.

* * * * *

UNITED STATES PATENT OFFICE

CERTIFICATE OF CORRECTION

PATENT NO. : 3,948,285

DATED : April 6, 1976

INVENTOR(S) : CHARLES J. FLYNN

It is certified that error appears in the above-identified patent and that said Letters Patent are hereby corrected as shown below:

Column 6, line 1, before "means to the" insert therefor --closure--.

Signed and Sealed this

Tenth Day of August 1976

[SEAL]

*Attest:*

RUTH C. MASON
*Attesting Officer*

C. MARSHALL DANN
*Commissioner of Patents and Trademarks*